US008598473B2

(12) United States Patent
Williamson et al.

(10) Patent No.: US 8,598,473 B2
(45) Date of Patent: Dec. 3, 2013

(54) BUS BAR ELECTRICAL FEEDTHROUGH FOR ELECTROREFINER SYSTEM

(75) Inventors: Mark Á Williamson, Naperville, IL (US); Stanley G. Wiedmeyer, Glen Ellyn, IL (US); James L. Willit, Batavia, IL (US); Laurel A. Barnes, Chicago, IL (US); Robert J. Blaskovitz, Lockport, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 21 days.

(21) Appl. No.: 13/335,139

(22) Filed: Dec. 22, 2011

(65) Prior Publication Data

US 2013/0161091 A1 Jun. 27, 2013

(51) Int. Cl.
*H02G 3/18* (2006.01)

(52) U.S. Cl.
USPC ..... 174/659; 174/72 B; 174/99 B; 439/211; 361/611

(58) Field of Classification Search
USPC ..... 174/659, 72 B, 71 B, 88 B, 99 B; 439/211, 517; 361/611
See application file for complete search history.

(56) References Cited

U.S. PATENT DOCUMENTS

| | | | |
|---|---|---|---|
| 422,139 | A | 2/1890 | Maxon |
| 2,089,738 | A | 8/1935 | Elmer |
| 2,800,219 | A | 7/1957 | Carroll |
| 3,562,131 | A | 2/1971 | Jasberg |
| 3,697,404 | A | 10/1972 | Paige, P.M. |
| 4,013,329 | A | 3/1977 | Hugin |
| 4,039,403 | A | 8/1977 | Astley et al. |
| 4,073,703 | A | 2/1978 | Kinosz |
| 4,203,531 | A | 5/1980 | Reichel et al. |
| 4,492,621 | A | 1/1985 | Stubb |
| 4,668,353 | A | 5/1987 | Smith et al. |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

Jeong, et al., "Electrolytic production of metallic Uranium from U308 in a 20-kg batch scale reactor", Journal of Radioanalytical and Nuclear Chemistry, vol. 268, No. 2, pp. 349-356 (2006).

(Continued)

*Primary Examiner* — Dhirubhai R Patel
(74) *Attorney, Agent, or Firm* — Harness, Dickey & Pierce, P.L.C.

(57) ABSTRACT

A bus bar electrical feedthrough for an electrorefiner system may include a retaining plate, electrical isolator, and/or contact block. The retaining plate may include a central opening. The electrical isolator may include a top portion, a base portion, and a slot extending through the top and base portions. The top portion of the electrical isolator may be configured to extend through the central opening of the retaining plate. The contact block may include an upper section, a lower section, and a ridge separating the upper and lower sections. The upper section of the contact block may be configured to extend through the slot of the electrical isolator and the central opening of the retaining plate. Accordingly, relatively high electrical currents may be transferred into a glovebox or hot-cell facility at a relatively low cost and higher amperage capacity without sacrificing atmosphere integrity.

11 Claims, 8 Drawing Sheets

(56) References Cited

U.S. PATENT DOCUMENTS

| | | | | |
|---|---|---|---|---|
| 4,851,098 | A | 7/1989 | Kimura | |
| 4,863,580 | A | 9/1989 | Epner | |
| 4,880,506 | A | 11/1989 | Ackerman et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,935,394 | A | 8/1999 | Sivilotti et al. | |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Barnett et al. | |
| 7,090,760 | B2 | 8/2006 | Seo et al. | |
| 7,449,635 | B2 * | 11/2008 | Wiant | 174/68.2 |
| 7,563,982 | B2 * | 7/2009 | Kimmel | 174/72 B |
| 7,638,026 | B1 | 12/2009 | Willit et al. | |
| 7,799,185 | B1 | 9/2010 | Willit | |
| 2004/0007466 | A1 | 1/2004 | Seo et al. | |
| 2004/0134785 | A1 | 7/2004 | Gay et al. | |
| 2004/0168932 | A1 | 9/2004 | Wang | |
| 2005/0067291 | A1 | 3/2005 | Haiki et al. | |
| 2005/0205428 | A1 | 9/2005 | Dees et al. | |
| 2005/0233634 | A1 | 10/2005 | Kollmann | |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0152270 | A1 | 6/2008 | Engesser et al. | |
| 2009/0050483 | A1 | 2/2009 | Li | |
| 2009/0152124 | A1 | 6/2009 | Ashford et al. | |
| 2010/0276259 | A1 | 11/2010 | Phalen | |
| 2011/0180409 | A1 | 7/2011 | Willit et al. | |

FOREIGN PATENT DOCUMENTS

| | | |
|---|---|---|
| DE | 26 00 344 | 7/1977 |
| DE | 3837572 | 5/1989 |
| DE | 19845258 | 3/2000 |
| EP | 0 286 092 | 10/1988 |
| EP | 0 736 929 | 10/2009 |
| EP | 2224542 | 9/2010 |
| GB | 284678 | 11/1928 |
| GB | 506590 | 5/1939 |
| GB | 516775 | 1/1940 |
| JP | H05279887 | 10/1993 |
| JP | H0972991 | 3/1997 |
| JP | 2006-308442 | 11/2006 |
| WO | WO 02/066709 | 8/2002 |
| WO | WO 2004/018737 | 3/2004 |
| WO | WO 2004/031453 | 4/2004 |
| WO | WO 2005/035404 | 4/2005 |
| WO | WO 2006/007863 | 1/2006 |
| WO | WO 2009/062005 | 5/2009 |
| WO | WO 2010/080761 | 7/2010 |

OTHER PUBLICATIONS

"Proceedings of Global 2005", Tsukuba, Japan, Oct. 9-13, 2005, Paper No. 488.

International Search Report dated Jan. 20, 2012 issued in PCT/US2011/053589.

International Search Report dated Jan. 30, 2012 issued in PCT/US2011/053878.

International Search Report dated Feb. 6, 2012 issued in PCT/US2011/053872.

International Search Report dated May 11, 2012 issued in PCT/US2011/053871.

"Electrolytic Reduction of Spent Oxide Fuel-Bench-Scale Test Results", Steven D. Herman, Shelly X. Li, Michael F. Simpson.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report and Written Opinion issued in International Patent Application No. PCT/US2012/058663, issued Aug. 12, 2013.

International Search Report and Written Opinion issued in International Patent Application No. PCT/US2012/058531, issued Aug. 2, 2013.

European Search Report issued in European Patent Application No. 13163951.0, issued Aug. 29, 2013.

* cited by examiner

BUS BAR ELECTRICAL FEEDTHROUGH FOR ELECTROREFINER SYSTEM

FEDERALLY SPONSORED RESEARCH OR DEVELOPMENT

The present invention was made with Government support under contract number DE-AC02-06CH11357, which was awarded by the U.S. Department of Energy.

BACKGROUND

1. Field

The present invention relates to an electrical feedthrough for an electrolytic system configured to recover a metal from an impure feed material.

2. Description of Related Art

An electrochemical process may be used to recover metals from an impure feed and/or to extract metals from a metal-oxide. A conventional process (for soluble metal oxides) typically involves dissolving a metal-oxide in an electrolyte followed by electrolytic decomposition or (for insoluble metal oxides) selective electrotransport to reduce the metal-oxide to its corresponding metal. Conventional electrochemical processes for reducing insoluble metal-oxides to their corresponding metallic state may employ a single step or multiple-step approach.

A multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium metal and $Li_2O$ in a first vessel, wherein the $Li_2O$ remains dissolved in the molten LiCl electrolyte. The process then involves a subsequent step of electrowinning in a second vessel, wherein the dissolved $Li_2O$ in the molten LiCl is electrolytically decomposed to form oxygen gas and regenerate lithium. Consequently, the resulting uranium metal may be extracted in an electrorefining process, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide (which is in electrical contact with the cathode) can be reduced to its corresponding metal through electrolytic conversion and ion exchange through the molten electrolyte. However, although a conventional single-step approach may be less complex than a multi-step approach, the yield of the metallic product is relatively low. Furthermore, the metallic product still contains unwanted impurities.

SUMMARY

A bus bar electrical feedthrough for an electrorefiner system may include a retaining plate, an electrical isolator, and/or a contact block. The retaining plate may include a central opening. The electrical isolator may include a top portion, a base portion, and a slot extending through the top and base portions. The top portion of the electrical isolator may be configured to extend through the central opening of the retaining plate. The contact block may include an upper section, a lower section, and a ridge separating the upper and lower sections. The upper section of the contact block may be configured to extend through the slot of the electrical isolator and the central opening of the retaining plate.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
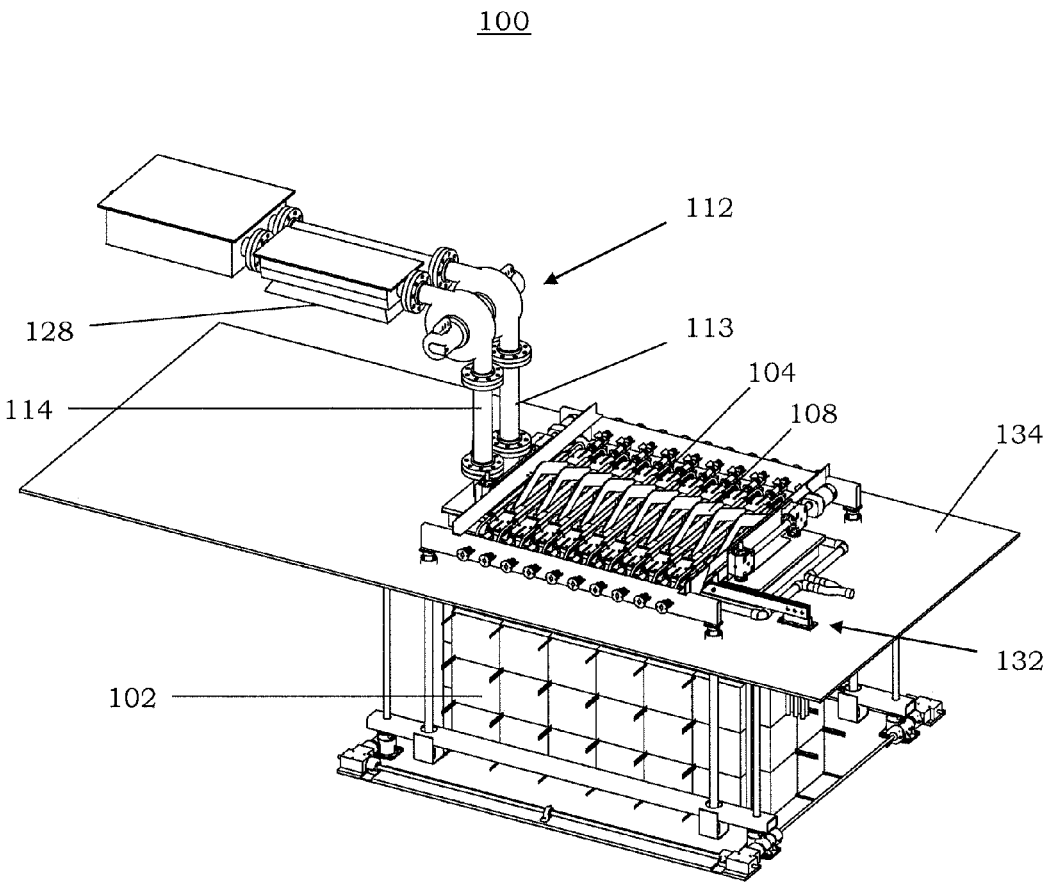
FIG. 1 is a perspective view of an electrorefiner system including an electrical feedthrough according to a non-limiting embodiment of the present invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term in "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

An electrorefiner system according to a non-limiting embodiment of the present invention may be used to recover a purified metal (e.g., uranium) from a relatively impure nuclear feed material (e.g., impure uranium feed material). The electrorefiner system may be as described in U.S. application Ser. No. 13/335,082, HDP Ref. 8564-000252/US, GE Ref. 24NS250931, filed on even date herewith, titled "ELECTROREFINER SYSTEM FOR RECOVERING PURIFIED METAL FROM IMPURE NUCLEAR FEED MATERIAL," the entire contents of which are incorporated herein by reference. The impure nuclear feed material may be a metallic product of an electrolytic oxide reduction system. The electrolytic oxide reduction system may be configured to facilitate the reduction of an oxide to its metallic form so as to permit the subsequent recovery of the metal. The electrolytic oxide reduction system may be as described in U.S. application Ser. No. 12/978,027, filed Dec. 23, 2010, "ELECTROLYTIC OXIDE REDUCTION SYSTEM," HDP Ref.: 8564-000228/US, GE Ref.: 24AR246140, the entire contents of which is incorporated herein by reference.

Generally, the electrorefiner system may include a vessel, a plurality of cathode assemblies, a plurality of anode assemblies, a power system, a scraper, and/or a conveyor system. The power system may be as described in U.S. application Ser. No. 13/335,121, HDP Ref. 8564-000254/US, GE Ref. 24AR252783, filed on even date herewith, titled "CATHODE POWER DISTRIBUTION SYSTEM AND METHOD OF USING THE SAME FOR POWER DISTRIBUTION," the entire contents of which are incorporated herein by reference. The scraper may be as described in U.S. application Ser. No. 13/335,209, HDP Ref. 8564-000255/US, GE Ref. 24AR252787, filed on even date herewith, titled "CATHODE SCRAPER SYSTEM AND METHOD OF USING THE SAME FOR REMOVING URANIUM," the entire contents of which are incorporated herein by reference. The conveyor system may be as described in U.S. application Ser. No. 13/335,140, HDP Ref. 8564-000260/US, GE Ref. 24AR256355, filed on even date herewith, titled "CONTINUOUS RECOVERY SYSTEM FOR ELECTROREFINER SYSTEM," the entire contents of which are incorporated herein by reference. However, it should be understood that the electrorefiner system is not limited thereto and may include other components that may not have been specifically identified herein. Furthermore, the electrorefiner system and/or electrolytic oxide reduction system may be used to perform a method for corium and used nuclear fuel stabilization processing. The method may be as described in U.S. application Ser. No. 13/453,290, HDP Ref. 8564-000262/US, GE Ref. 24AR253193, filed on Apr. 23, 2012, titled "METHOD FOR CORIUM AND USED NUCLEAR FUEL STABILIZATION PROCESSING," the entire contents of which are incorporated herein by reference. A table of the incorporated applications being filed on even date herewith is provided below.

Related Applications Incorporated by Reference

| U.S. application No. | HDP/GE Ref. | Filing Date | Title |
|---|---|---|---|
| 13/335,082 | 8564-000252/US 24NS250931 | Filed on even date herewith | ELECTROREFINER SYSTEM FOR RECOVERING PURIFIED METAL FROM IMPURE NUCLEAR FEED MATERIAL |
| 13/335,121 | 8564-000254/US 24AR252783 | Filed on even date herewith | CATHODE POWER DISTRIBUTION SYSTEM AND METHOD OF USING THE SAME FOR POWER DISTRIBUTION |

-continued

| Related Applications Incorporated by Reference | | | |
|---|---|---|---|
| U.S. application No. | HDP/GE Ref. | Filing Date | Title |
| 13/335,209 | 8564-000255/US 24AR252787 | Filed on even date herewith | CATHODE SCRAPER SYSTEM AND METHOD OF USING THE SAME FOR REMOVING URANIUM |
| 13/335,140 | 8564-000260/US 24AR256355 | Filed on even date herewith | CONTINUOUS RECOVERY SYSTEM FOR ELECTROREFINER SYSTEM |
| 13/453,290 | 8564-000262/US 24AR253193 | Filed on Apr. 23, 2012 | METHOD FOR CORIUM AND USED NUCLEAR FUEL STABILIZATION PROCESSING |

As noted above, the impure nuclear feed material for the electrorefiner system may be a metallic product of an electrolytic oxide reduction system. During the operation of an electrolytic oxide reduction system, a plurality of anode and cathode assemblies are immersed in a molten salt electrolyte. In a non-limiting embodiment of the electrolytic oxide reduction system, the molten salt electrolyte may be lithium chloride (LiCl). The molten salt electrolyte may be maintained at a temperature of about 650° C. (+50° C., −30° C.). An electrochemical process is carried out such that a reducing potential is generated at the cathode assemblies, which contain the oxide feed material (e.g., metal oxide). Under the influence of the reducing potential, the metal ion of the metal oxide is reduced to metal and the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-}\rightarrow \tfrac{1}{2}O_2+2e^{-}$$

The metal oxide may be uranium dioxide ($UO_2$), and the reduction product may be uranium metal. However, it should be understood that other types of oxides may also be reduced to their corresponding metals with the electrolytic oxide reduction system. Similarly, the molten salt electrolyte used in the electrolytic oxide reduction system is not particularly limited thereto and may vary depending of the oxide feed material to be reduced.

After the electrolytic oxide reduction, the basket containing the metallic product in the electrolytic oxide reduction system is transferred to the electrorefiner system according to the present invention for further processing to obtain a purified metal from the metallic product. Stated more clearly, the metallic product from the electrolytic oxide reduction system will serve as the impure nuclear feed material for the electrorefiner system according to the present invention. Notably, while the basket containing the metallic product is a cathode assembly in the electrolytic oxide reduction system, the basket containing the metallic product is an anode assembly in the electrorefiner system. Compared to prior art apparatuses, the electrorefiner system according to the present invention allows for a significantly greater yield of purified metal.

Figure 2:
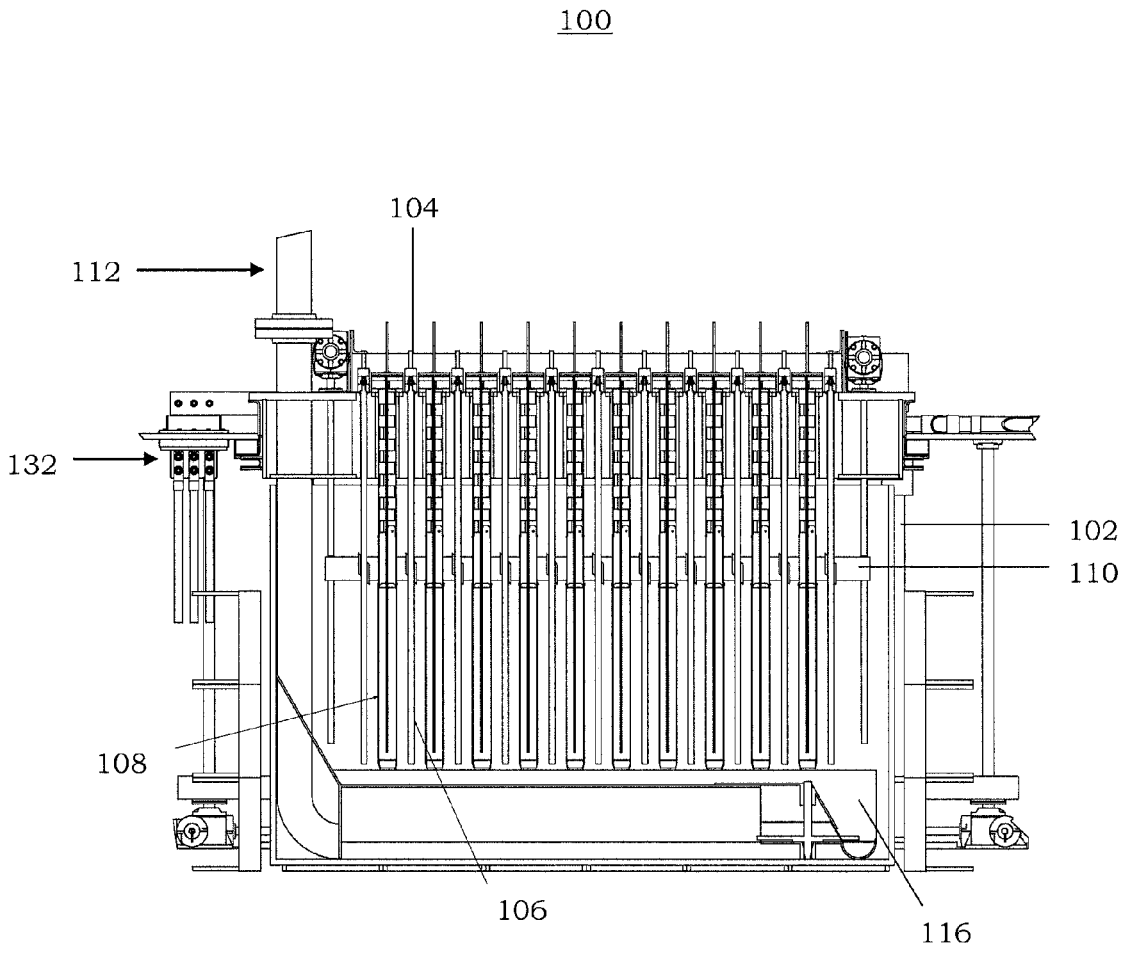
FIG. 2 is a cross-sectional side view of an electrorefiner system including an electrical feedthrough according to a non-limiting embodiment of the present invention.

FIG. 1 is a perspective view of an electrorefiner system including an electrical feedthrough according to a non-limiting embodiment of the present invention. FIG. 2 is a cross-sectional side view of an electrorefiner system including an electrical feedthrough according to a non-limiting embodiment of the present invention.

Referring to FIGS. 1-2, the electrorefiner system 100 includes a vessel 102, a plurality of cathode assemblies 104, a plurality of anode assemblies 108, a power system, a scraper 110, and/or a conveyor system 112. Each of the plurality of cathode assemblies 104 may include a plurality of cathode rods 106. The power system may include an electrical feedthrough 132 that extends through the floor structure 134. The floor structure 134 may be a glovebox floor in a glovebox. Alternatively, the floor structure 134 may be a support plate in a hot-cell facility. The conveyor system 112 may include an inlet pipe 113, a trough 116, a chain, a plurality of flights, an exit pipe 114, and/or a discharge chute 128.

The vessel 102 is configured to maintain a molten salt electrolyte. In a non-limiting embodiment, the molten salt electrolyte may be LiCl, a LiCl—KCl eutectic, or another suitable medium. The vessel 102 may be situated such that a majority of the vessel 102 is below the floor structure 134. For instance, an upper portion of the vessel 102 may extend above the floor structure 134 through an opening in the floor structure 134. The opening in the floor structure 134 may correspond to the dimensions of the vessel 102. The vessel 102 is configured to receive the plurality of cathode assemblies 104 and the plurality of anode assemblies 108.

The plurality of cathode assemblies 104 are configured to extend into the vessel 102 so as to at least be partially submerged in the molten salt electrolyte. For instance, the dimensions of the plurality of cathode assemblies 104 and/or the vessel 102 may be adjusted such that the majority of the length of the plurality of cathode assemblies 104 is submerged in the molten salt electrolyte in the vessel 102. Each cathode assembly 104 may include a plurality of cathode rods 106 having the same orientation and arranged so as to be within the same plane.

The plurality of anode assemblies 108 may be alternately arranged with the plurality of cathode assemblies 104 such that each anode assembly 108 is flanked by two cathode assemblies 104. The plurality of cathode assemblies 104 and anode assemblies 108 may be arranged in parallel. Each anode assembly 108 may be configured to hold and immerse an impure uranium feed material in the molten salt electrolyte maintained by the vessel 102. The dimensions of the plurality of anode assemblies 108 and/or the vessel 102 may be adjusted such that the majority of the length of the plurality of anode assemblies 108 is submerged in the molten salt electrolyte in the vessel 102. Although the electrorefiner system 100 is illustrated in FIGS. 1-2 as having eleven cathode assemblies 104 and ten anode assemblies 108, it should be understood that the example embodiments herein are not limited thereto.

In the electrorefiner system 100, a power system is connected to the plurality of cathode assemblies 104 and anode assemblies 108. As previously noted above, in addition to the disclosure herein, the power system may be as described in U.S. application Ser. No. 13/335,121, HDP Ref. 8564-000254/US, GE Ref. 24AR252783, filed on even date herewith, titled "CATHODE POWER DISTRIBUTION SYSTEM AND METHOD OF USING THE SAME FOR POWER DISTRIBUTION," the entire contents of which are incorporated herein by reference.

For instance, the plurality of cathode assemblies 104 may be connected to a common bus bar 118, and the common bus bar 118 may be connected to an electrical feedthrough 132 that extends through the floor structure 134. The electrical feedthrough 132 allows power to be supplied to the common bus bar 118 without loss of atmosphere containment of the hermetically sealed glovebox or hot-cell facility. During operation of the electrorefiner system 100, the power system is configured to supply a voltage adequate to oxidize the impure uranium feed material in the plurality of anode assemblies 108 to form uranium ions that migrate through the molten salt electrolyte and deposit on the plurality of cathode rods 106 of the plurality of cathode assemblies 104 as purified uranium.

To initiate the removal of the purified uranium, the scraper 110 is configured to move up and down along the length of the plurality of cathode rods 106 to dislodge the purified uranium deposited on the plurality of cathode rods 106 of the plurality of cathode assemblies 104. As a result of the scraping, the dislodged purified uranium sinks through the molten salt electrolyte to the bottom of the vessel 102.

The conveyor system 112 is configured such that at least a portion of it is disposed at the bottom of the vessel 102. For example, the trough 116 of the conveyor system 112 may be disposed at the bottom of the vessel 102 such that the purified uranium dislodged from the plurality of cathode rods 106 accumulates in the trough 116. The conveyor system 112 is configured to transport the purified uranium accumulated in the trough 116 through an exit pipe 114 to a discharge chute 128 so as to remove the purified uranium from the vessel 102.

Figure 3:
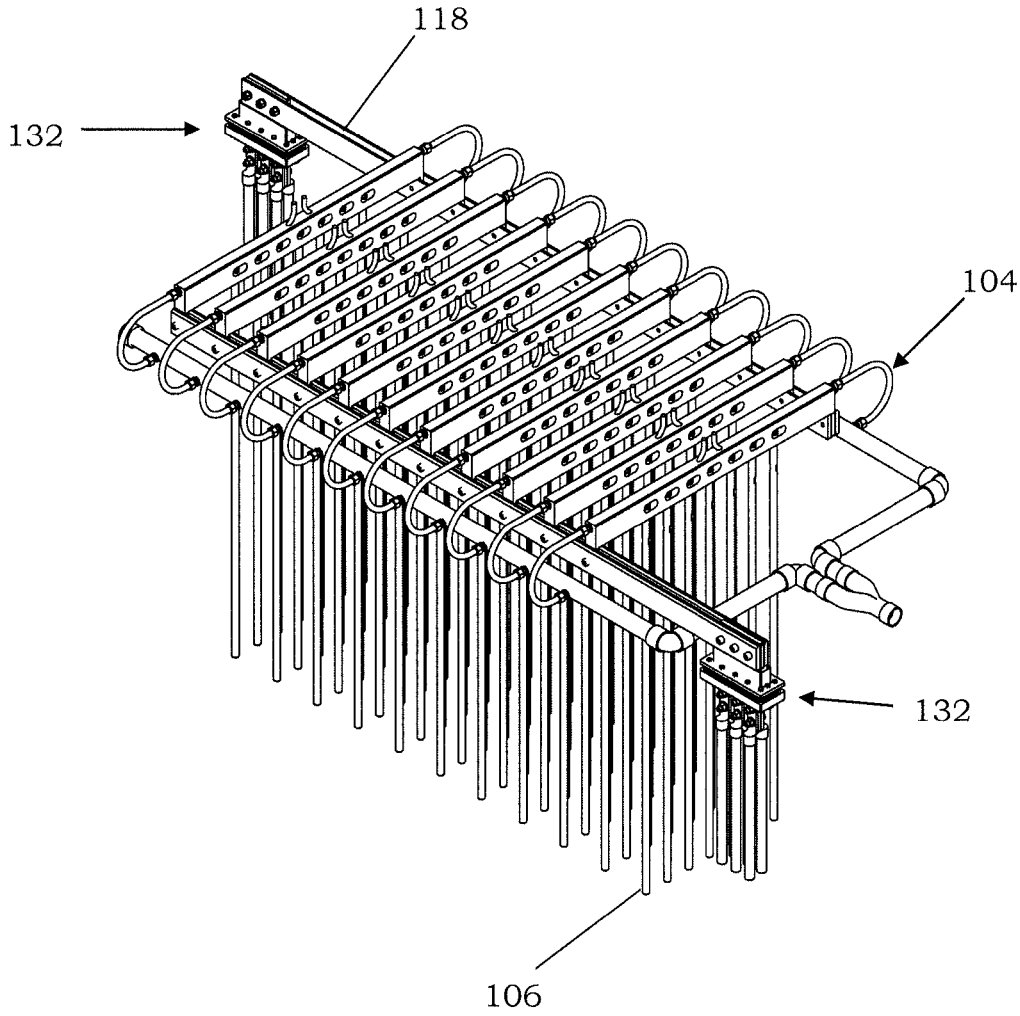
FIG. 3 is a perspective view of a plurality of cathode assemblies connected to a common bus bar and an electrical feedthrough of an electrorefiner system according to a non-limiting embodiment of the present invention.

FIG. 3 is a perspective view of a plurality of cathode assemblies connected to a common bus bar and an electrical feedthrough of an electrorefiner system according to a non-limiting embodiment of the present invention. Referring to FIG. 3, each of the plurality of cathode assemblies 104 includes a plurality of cathode rods 106. Although the plurality of cathode assemblies 104 are shown as having seven cathode rods 106 each, it should be understood that the example embodiments are not limited thereto. Thus, each cathode assembly 104 may include less than seven cathode rods 106 or more than seven cathode rods 106, provided that sufficient current is being provided to the electrorefiner system 100. The plurality of cathode assemblies 104 are connected to a common bus bar 118. When positioned within the vessel 102 of the electrorefiner system 100, the plurality of cathode assemblies 104 may be arranged parallel to each other and perpendicularly to the common bus bar 118. The common bus bar 118 is connected to an electrical feedthrough 132. As a result, power may be supplied to the common bus bar 118 through the floor structure 134 via the electrical feedthrough 132 without compromising the quality of the atmosphere inside the glovebox or hot-cell facility.

Figure 4:
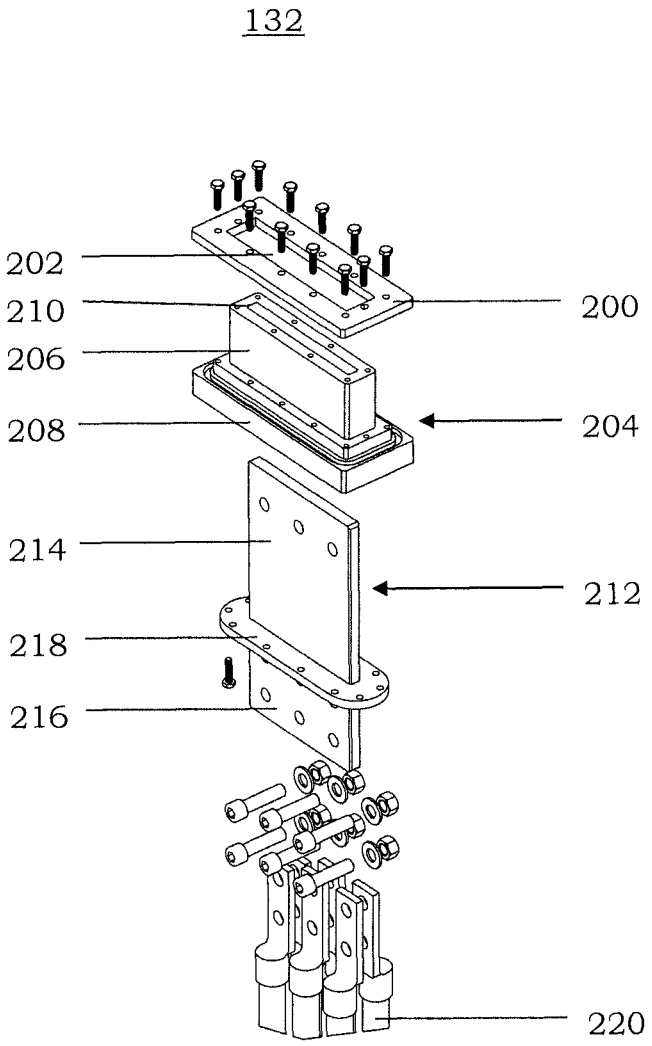
FIG. 4 is an exploded view of an electrical feedthrough of an electrorefiner system according to a non-limiting embodiment of the present invention.
Figure 5:
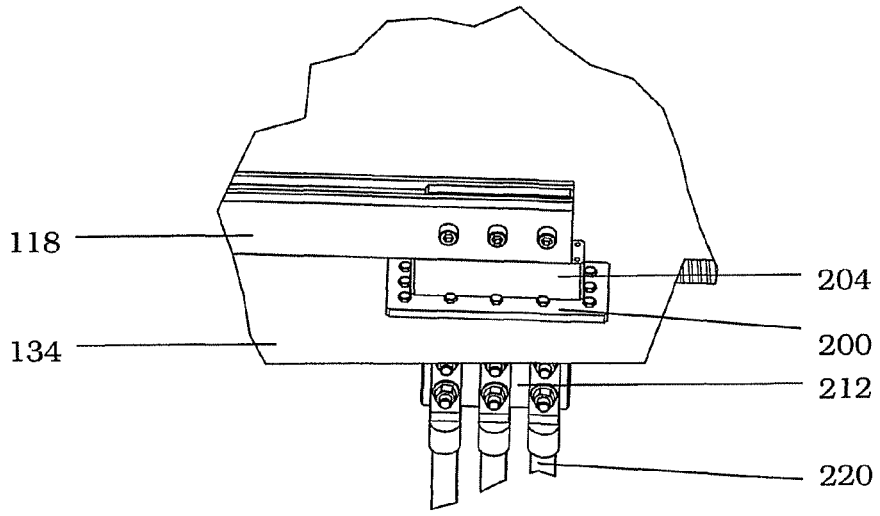
FIG. 5 is a partial top view of an electrical feedthrough of an electrorefiner system according to a non-limiting embodiment of the present invention.
Figure 6:
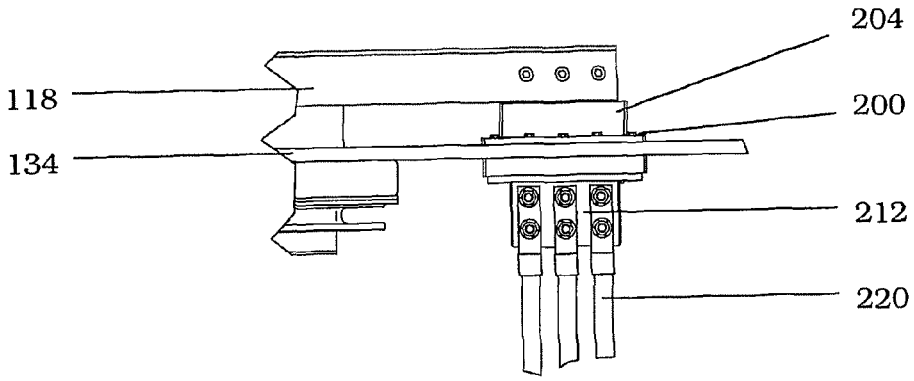
FIG. 6 is a partial side view of an electrical feedthrough of an electrorefiner system according to a non-limiting embodiment of the present invention.
Figure 7:
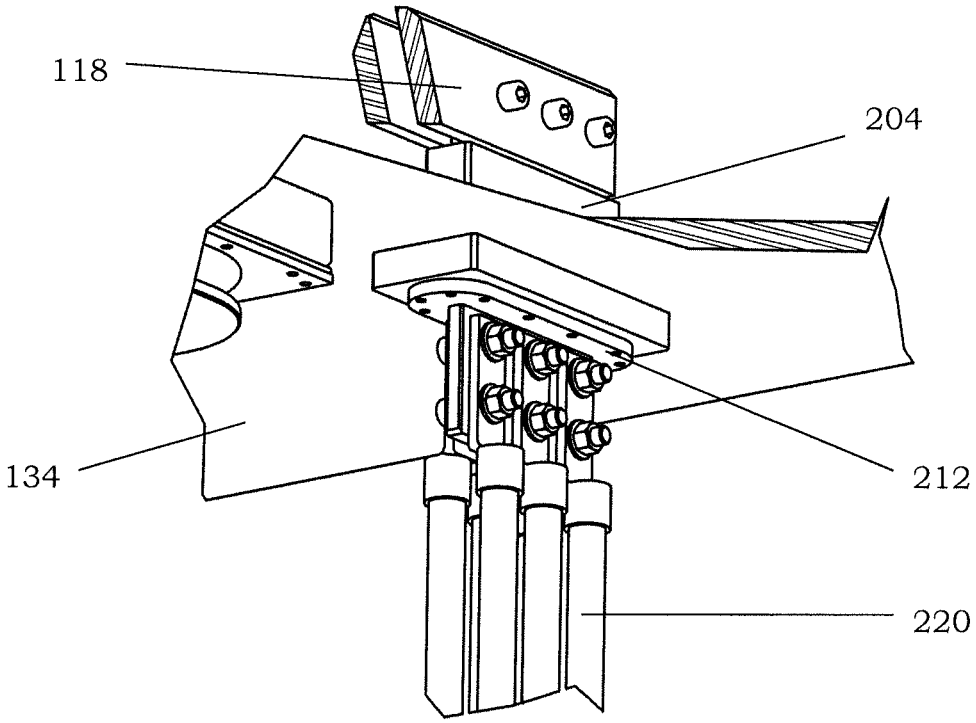
FIG. 7 is a partial bottom view of an electrical feedthrough of an electrorefiner system according to a non-limiting embodiment of the present invention.
Figure 8:
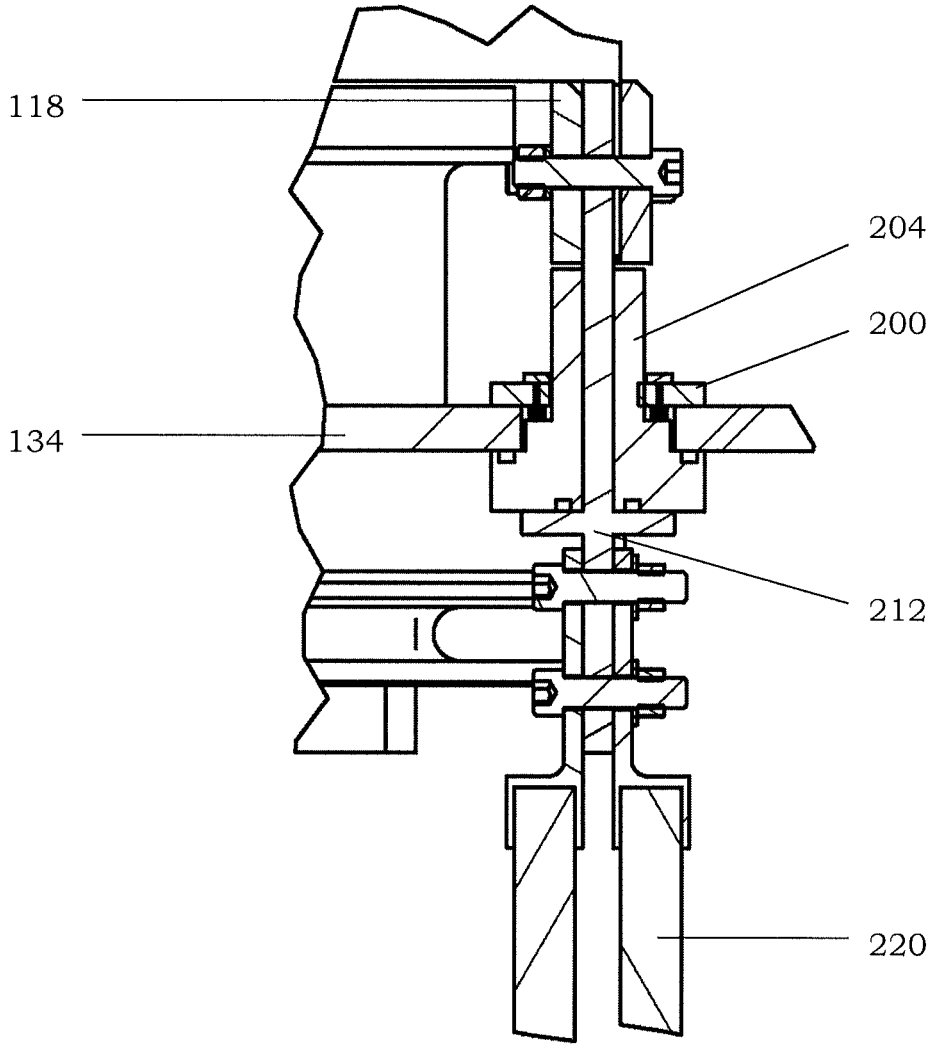
FIG. 8 is a cross-sectional end view of an electrical feedthrough of an electrorefiner system according to a non-limiting embodiment of the present invention.

FIG. 4 is an exploded view of an electrical feedthrough of an electrorefiner system according to a non-limiting embodiment of the present invention. FIG. 5 is a partial top view of an electrical feedthrough of an electrorefiner system according to a non-limiting embodiment of the present invention. FIG. 6 is a partial side view of an electrical feedthrough of an electrorefiner system according to a non-limiting embodiment of the present invention. FIG. 7 is a partial bottom view of an electrical feedthrough of an electrorefiner system according to a non-limiting embodiment of the present invention. FIG. 8 is a cross-sectional end view of an electrical feedthrough of an electrorefiner system according to a non-limiting embodiment of the present invention.

Referring to FIGS. 4-8, an electrical feedthrough 132 (also referred to as a bus bar electrical feedthrough) may include a retaining plate 200, an electrical isolator 204, and a contact block 212. The retaining plate 200, electrical isolator 204, and contact block 212 are designed to be united to form a single structural unit that is clamped onto a floor structure 134.

The retaining plate 200 includes a central opening 202. The electrical isolator 204 includes a top portion 206, a base portion 208, and a slot 210 extending through the top 206 and base portions 208. The top portion 206 of the electrical isolator 204 is configured to extend through the central opening 202 of the retaining plate 200. The contact block 212 includes an upper section 214, a lower section 216, and a ridge 218 separating the upper 214 and lower sections 216. The upper section 214 of the contact block 212 is configured to extend through the slot 210 of the electrical isolator 204 and the central opening 202 of the retaining plate 200.

The upper section 214 of the contact block 212 is configured for connection with one or more bus bars. For example, the upper section 214 of the contact block 212 may be connected to the common bus bar 118. To facilitate the connection, a plurality of connection holes are provided in the upper section 214 of the contact block 212. Although the upper section 214 of the contact block 212 is shown as having three connection holes, it should be understood that the example embodiments are not limited thereto.

The lower section 216 of the contact block 212 is configured for connection with one or more current supply cables. For example, the lower section 216 of the contact block 212 may be connected to the current supply cables 220. To facilitate the connection, a plurality of connection holes are provided in the lower section 216 of the contact block 212. Although the lower section 216 of the contact block 212 is shown as having three connection holes, it should be understood that the example embodiments are not limited thereto.

The retaining plate 200 may have a plurality of threaded holes surrounding the central opening 202, and the electrical isolator 204 may have a plurality of blind threaded holes in the base portion 208 surrounding the top portion 206. The plurality of threaded holes of the retaining plate 200 may be aligned with the plurality of blind threaded holes of the electrical isolator 204. As a result, when mounted so as to sandwich the floor structure 134, the retaining plate 200 may be secured to the electrical isolator 204 (with the floor structure 134 in between) with a plurality of screws. The contact block 212 also includes a plurality of threaded holes in the ridge 218 surrounding the upper section 214. The plurality of threaded holes of the contact block 212 allows the contact block 212 to be secured to the electrical isolator 204 with a plurality of screws.

The retaining plate 200 may be formed of a metal. The electrical isolator 204 may be formed of a plastic. For example, the plastic may be polyetherketone. The contact block 212 may be formed of copper. In a non-limiting embodiment, the copper may be silver plated.

The retaining plate 200 and the electrical isolator 204 are configured to clamp the floor structure 134 in between. Thus, when the electrical feedthrough 132 is properly installed, the retaining plate 200 will be on one surface of the floor structure 134. Additionally, the base portion 208 of the electrical isolator 204 will be pressed against the opposing surface of the floor structure 134, while the top portion 206 of the electrical isolator 204 extends through the floor structure 134 and the central opening 202 of the retaining plate 200. Furthermore, the ridge 218 of the contact block 212 will be pressed against the underside of the base portion 208 of the electrical isolator 204, while the upper section 214 of the contact block 212 extends through the electrical isolator 204, the floor structure 134, and the retaining plate 200 such that an exposed terminal portion of the upper section 214 of the contact block 212 protrudes from the slot 210 of the electrical isolator 204.

The electrical feedthrough 132 may further include at least one o-ring between the retaining plate 200 and the electrical isolator 204. The electrical feedthrough 132 may also further include an o-ring between the electrical isolator 204 and the ridge 218 of the contact block 212.

The electrical feedthrough 132 is configured to allow the contact block 212 to be removed and replaced (e.g., because of damage) without compromising the quality of the atmosphere inside the glovebox or hot-cell facility. For instance, the electrical feedthrough 132 may further include a cap configured to attach to the top portion 206 of the electrical isolator 204 so as to allow a removal of the contact block 212 without compromising an atmosphere of a hermetically-sealed glovebox or hot-cell facility. A plurality of threaded holes (FIG. 4) may be provided in the upper face of the top portion 206 surrounding the slot 210 to allow the cap to be secured to the electrical isolator 204. Thus, when the cap is secured to the upper face of the top portion 206 of the electrical isolator, the contact block 212 may be removed and repaired (or replaced) without compromising the atmosphere of the hermetically-sealed glovebox or hot-cell facility.

A method of electrorefining according to a non-limiting embodiment of the present invention may involve electrolytically processing a suitable feed material with the above-discussed electrorefiner system. As a result, the method may be used to recycle used nuclear fuel or recover a metal (e.g., uranium) from an off-specification metal oxide (e.g., uranium dioxide). Furthermore, as a result of the bus bar electrical feedthrough, relatively high electrical currents may be transferred into a glovebox or hot-cell facility at a relatively low cost and higher amperage capacity without sacrificing atmosphere integrity.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A bus bar electrical feedthrough comprising: a retaining plate including a central opening; an electrical isolator including a top portion, a base portion, and a slot extending through the top and base portions, the top portion configured to extend through the central opening of the retaining plate; and a contact block including an upper section, a lower section, and a ridge separating the upper and lower sections, the upper section configured to extend through the slot of the electrical isolator and the central opening of the retaining plate, wherein the upper section of the contact block is configured for connection with one or more bus bars.

2. The bus bar electrical feedthrough of claim 1, wherein the retaining plate is formed of a metal.

3. The bus bar electrical feedthrough of claim 1, wherein the electrical isolator is formed of a plastic.

4. The bus bar electrical feedthrough of claim 3, wherein the plastic is polyetherketone.

5. The bus bar electrical feedthrough of claim 1, wherein the contact block is formed of copper.

6. The bus bar electrical feedthrough of claim 5, wherein the copper is silver plated.

7. The bus bar electrical feedthrough of claim 1, wherein the lower section of the contact block is configured for connection with one or more current supply cables.

8. The bus bar electrical feedthrough of claim 1, wherein the retaining plate and the electrical isolator are configured to clamp a floor structure in between.

9. The bus bar electrical feedthrough of claim 1, further comprising:

at least one o-ring between the retaining plate and the electrical isolator.

10. The bus bar electrical feedthrough of claim 1, further comprising:

an o-ring between the electrical isolator and the ridge of the contact block.

11. The bus bar electrical feedthrough of claim 1, further comprising:

a cap configured to attach to the top portion of the electrical isolator so as to allow a removal of the contact block without compromising an atmosphere of a hermetically-sealed glovebox or hot-cell facility.

* * * * *